US006439535B1

(12) United States Patent
Mirza

(10) Patent No.: US 6,439,535 B1
(45) Date of Patent: Aug. 27, 2002

(54) FLOATABLE SYSTEM FOR ARTWORK

(76) Inventor: Felix Mirza, 33 Vista Florence, Laguna Hills, CA (US) 92563

( * ) Notice: Subject to any disclaimer, the term of this patent is extended or adjusted under 35 U.S.C. 154(b) by 0 days.

(21) Appl. No.: 09/699,185

(22) Filed: Oct. 27, 2000

(51) Int. Cl.[7] ..... A47G 1/16

(52) U.S. Cl. ..... 248/467; 248/476; 40/594; 24/683

(58) Field of Search ..... 248/467, 476, 248/683, 205.3, 205.4; 40/594, 760, 630; 24/683, 304, 306

(56) References Cited

U.S. PATENT DOCUMENTS 2,030,135 A * 2/1936 Carpenter ..... 24/67 R
2,486,593 A * 11/1949 Gardner ..... 248/544
4,057,923 A * 11/1977 Chase ..... 40/773
4,268,000 A * 5/1981 Ulm ..... 248/467
4,991,330 A * 2/1991 Heidari ..... 40/772
5,226,996 A * 7/1993 Schober ..... 156/226
5,437,428 A * 8/1995 Mirza ..... 248/467
6,004,642 A * 12/1999 Langford ..... 428/40.1
6,120,867 A * 9/2000 Hamerski et al. ..... 428/40.1

* cited by examiner

*Primary Examiner*—Leslie A. Braun
*Assistant Examiner*—Deborah Brann
(74) *Attorney, Agent, or Firm*—Frank L. Zugelter

(57) ABSTRACT

An assembly (20) of artwork (21) and backing (22) wherein a combination of floater anchors (24), hard anchors (26), and soft anchors (25) produce a floatability of artwork about its backing and which eliminates curling or rippling to it due to temperature and humidity changes. The floater anchor (24) is formed from a pair of tape pieces (35-1, 35-2) fastened together by a pair of crossing ties (37, 38) that interlace the pieces (35-1, 35-2). Piece (35-1) is adhered to artwork (21) and piece (35-2) is adhered to backing (22), whereby artwork (21) can shift about backing (22) to the extent of the spacing distance between the attachment, such as by glue spots (40), of ties(37, 38)to pieces (35-1, 35-2). Hard anchors (26) are formed by providing ribbons (42) of glue between pieces (35-1, 35-2) and ties (37, 38) so that the pieces (35-1, 35-2) do not shift between each other. Soft anchor (25) is a state-of-the-art element, however, in utilization of this invention, prevents swinging and pivoting of artwork about an applied hard anchor (26) as well as supporting for the weight of artwork (21) on backing (22).

20 Claims, 2 Drawing Sheets

35

35-1
40
40
40
37
40

35-1
38
40
40
37

35-2
35-1
37
24
38

36
35c
35n
35

35c
35n
36

35c
36
35n 22
29
31
28
29
29
30
30

25
43
43

35-1
38
42
42
37
42
42
35-2
35-1
35-1
42
42
42
35-1
42
26

FLOATABLE SYSTEM FOR ARTWORK

TECHNICAL FIELD

This invention is directed to a system and method of preparation for mounting an artwork in a floatable mode upon its backing, and the assembly thereof, and by which curling, rippling, or other deleterious or deteriorating effects on the artwork due to changes in temperature and humidity are eliminated.

BACKGROUND TO THE INVENTION

My U.S. Pat. #5,437,428, granted Aug. 1, 1995, discloses an earlier picture frame mount over which the instant invention is an advance. The listed patents (by their numbers) therein together with the prior art references made of record in the prosecution of that patent disclose data pertaining to mounting an artwork on a backing.

SUMMARY OF THE INVENTION

This invention involves utilization in one or more combinations of soft, hard, and floater anchors affixed to both a work of art on paper [hereinafter "artwork"] and a backing sheet [hereinafter "backing"] to which the artwork is to be mounted and sustained thereon; and further to the assembly of these elements and by which the artwork floats on its backing. Temperature and humidity detrimentally or deleteriously affect an artwork directly mounted to a backing, i.e., being attached directly to one another, resulting in the curling or rippling of the artwork as temperature and/or humidity affect it over a period of time, distorting it in kind or degree, thus the artwork losing its value. With a truer floatability available for the artwork and its backing, the expansion or contraction of the artwork's substance because of temperature and humidity changes do not alter the fine character of the artwork floated to the backing.

In the assembly of artwork to backing in this invention, a step-wise preparation is undertaken prior to the actual mounting of artwork to backing, utilizing this invention. There is first a useful step of locating the position of the artwork on the backing by indicating on the backing a boundary for the artwork, so that a desired finished arrangement or assembly between the two is achieved. The use of an indicium/indicia placed on the backing, such as a reference line, e.g., a center line, assists at this point in the preparation. Then, in a series of steps (not necessarily in the order herein immediately or hereinafter described) one or more in number of floater anchor members, or in combination with one or more soft anchor, and/or hard anchor members, at particular or spaced points are applied on the backing, prior to mounting the artwork on the backing. The floater anchor members, in number or in combination with one or more of the soft and/or hard anchor members, provide the feature and advantage of a truer floatability of the artwork relative to its backing over previous advances in the art, upon applying the artwork thereto. The hard anchor members are formed from a floater anchor member, however, its components fastened together in a different manner than that for the floater anchor members.

In more particularity, a floater anchor is a pair of suitably-sized pieces joined together, one over or on top of the other, by a pair of connecting ties in the form of strips, in such a manner that the first piece can move or shift in a gliding or sliding motion relative to the second piece to the extent of clearance from attachment in the distance between the attaching points of the ties to their respective or corresponding pieces. Each piece includes a neutral or non-adhesive side to which a corresponding tie is secured at such points and by which the pieces are interlaced to each other. The first tie secured to the first piece undercrosses the second tie that is secured to its second piece, effecting such interlacing on the facing neutral or non-adhesive sides of the pieces. Adhesive materials or characteristics are disposed on the non-facing or outer sides of each of the joined pieces. Thus, the adhesive side of the first piece is ready for attachment to an artwork and the adhesive side of the second piece is ready for attachment to its backing, and a truer floatability of artwork to backing is achieved when used in the process or method of assembling artwork to a backing.

A hard anchor is formed from the elements of a floater anchor, however, being fastened together in a manner not the same as with the floater anchor.

An object of this invention is to eliminate rippling and/or curling to an artwork when mounted to its backing.

Another object of this invention is to provide a floatability between artwork and its backing when mounted to one another and by which rippling and curling of the artwork is eliminated.

Yet another object of this invention is to provide various arrangements and combinations of tape-like members that connect the artwork to its backing to attain such floatability.

Still another object of this invention is to provide or retain a facile application or method of mounting an artwork to its backing with the practice of this invention.

Still another object of this invention is to prevent sagging or change of the artwork's positioning in its assembly to its backing.

A further object of this invention is to prevent damage to the artwork during handling, shipping, or turning the assembly around and/or up-side down or in other directions, which in instances cause damage thereto.

These and other objects and advantages will become more apparent upon a full and complete reading of the following description, the appended claims thereto, and the accompanying drawing comprising two (2) sheets of twelve (12) FIGURES.

PREFERRED EMBODIMENT OF CARRYING OUT THE INVENTION

Figure 1:
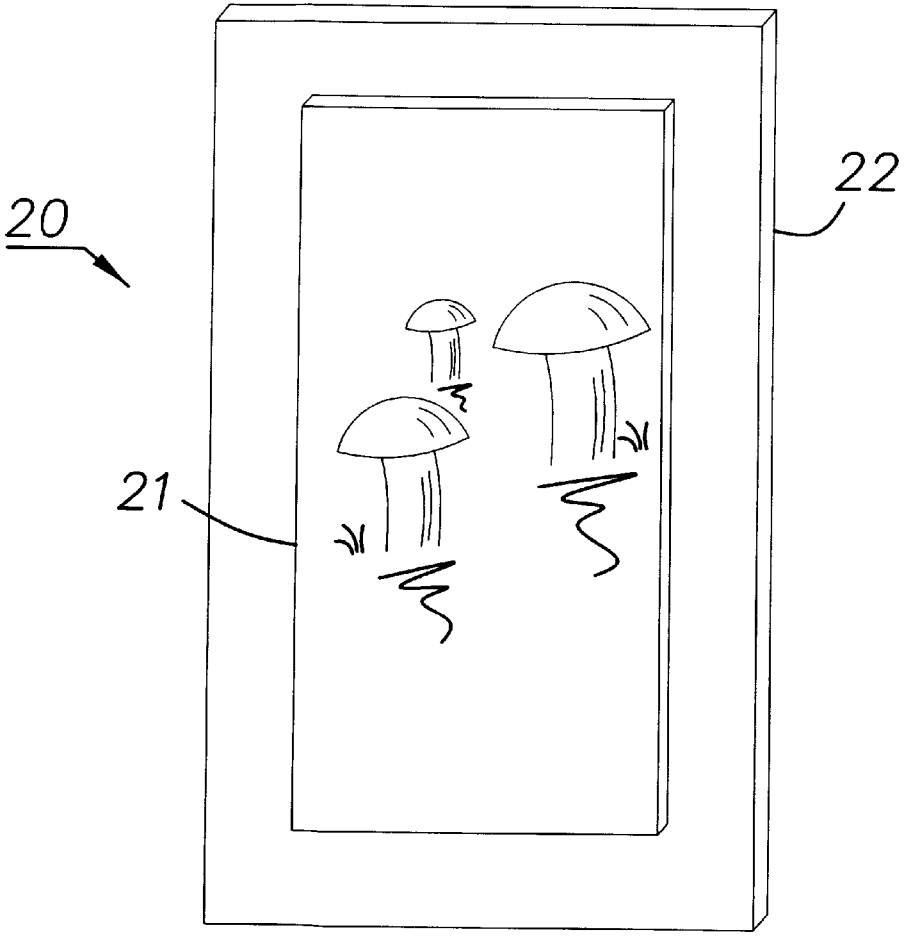
FIG. 1 is a perspective (close to a plan) view of an assembly of artwork to its backing as practiced by this invention.

Referring now to the drawing wherein reference characters correspond to like numerals hereinafter, FIG. 1 illustrates a finished assembly 20 of an artwork 21 to a backing 22 produced by the assembly or mounting between them and as connected by the utilization of one or more combinations of one, some, or all of a group or series of floater anchor members 24, FIG. 3*d*, soft anchor members 25, FIG. 4, and hard anchor members 26, FIG. 2, respectively. [Note: the artistic rendering of artwork 21 illustrated in FIG. 1 is removed in FIG. 2 for the purpose of clarity in the description of subject matter of the invention.] As a starting consideration for practice of the invention with these anchor members, various ways to position an artwork 21 over its backing 22 is first undertaken. As an example of such consideration, FIG. 5, wherein the topside 28 of backing 22 is illustrated, one or more of a number of indicia 29 are applied at appropriate points or lengths to topside 28 for locating or spotlighting a desired boundary 30 on the backing 22 and to which artwork is to be bound in the finished assembly with backing 22. Pencilled lines 31 also can be imposed on backing 22 to locate a boundary 30. Indicia 29 take the form of conveniently sized one-sided adhesive members, such as a self-stick note sheet exemplified by a "Post-it"[™] removable note sheet commercially available and made by the 3M Company, St. Paul, Minn., USA. Usually the boundary 30 of an artwork 21 is of a rectangular dimension, although an indicium 29 may include a curvilinear edge as well to coincide with a like edge for an artwork 21 and having its curvilinear edge positioned along points or lengths of a curvilinear boundary 30 previously identified or located on backing 22. Elongated weights (not illustrated) of an appropriate or suitable size and length also may provide the manner or way by which location of the artwork's boundary 30 can be determined on backing 22. A length of masking tape (not illustrated ) is suitable as an indicium 29, however, it should not be manually pressed hard to backing 22 but faintly pressed in a manner so as not to damage backing 22 itself, as well as being readily removable prior to mounting an artwork 21 to backing 22.

Figure 2:
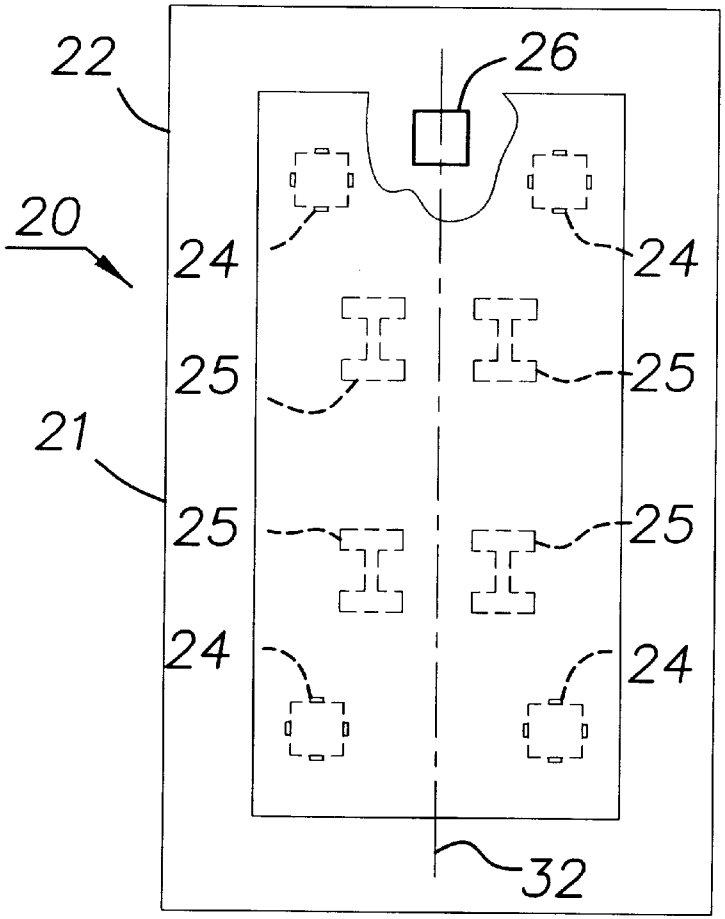
FIG. 2 is a plan view of an assembly of artwork to backing, partially broken away to show a hard anchor while floater and soft anchors are shown in place and in phantom between the artwork and its backing.

Turning to FIG. 2, a "hard anchor" member 26, more fully described hereinafter, now is manually applied to backing 22 at or on a planned line 32 as a reference point or center line for placing of artwork 21 on backing 21. Member 26 is applied within the confines of boundary 30, such placement preferably adjacent to or near the top edge of the boundary 30 for artwork 21. Hard anchor member 26 facilitates the preserving of an artwork removed from its backing should the removal of artwork from backing be required or desired.

A set of "floater anchor" members" 24, FIGS. 3*a*–3*f*, are manually applied to backing 22 in preparation of mounting artwork 21 thereto. They are illustrated in FIG. 2 in phantom, disposed within the general confines of the corners of the artwork 21 to be mounted to backing 22, being concealed by backing 22 in the finished assembly 20 of artwork 21 and backing 22. A floater anchor member 24 is formed of a material(s) 35, FIG. 3*a*, having an adhesive characteristic on its one side and a neutral or non-adhesive characteristic on its other side. The product, "filmoplast SH" [™], made in the form of a roll of tape, commercially available from Neschen Corporation, 2201 Brentwood Road, Suite 114, Raleigh NC. 27604 USA, readily provides a convenient single material that includes both the adhesive and neutral non-adhesive characteristics in a tape which can form a floater member 24. This product also is conducive to the formation of the soft and hard anchor members 25, 26, respectively, as well, for practice of this invention. The product is an acid-free product and is made of a fine threaded white linen material coated with an exceptionally strong water-based self adhesive 35*c* that is protected in its non-used condition by a covering film 36, FIGS. 3*e*, 3*f*. The product is of an archival quality, tested by the Federal Institute for Testing, File: ref. 3.3/8352/90, and purchasable in the form of a roll of tape. The white linen material constitutes the non-adhesive element 35*n* utilized in the practice of the invention.

Figures 3A, 3B, 3C, 3D, 3E, 3F, 3G, 4, 5, 6:
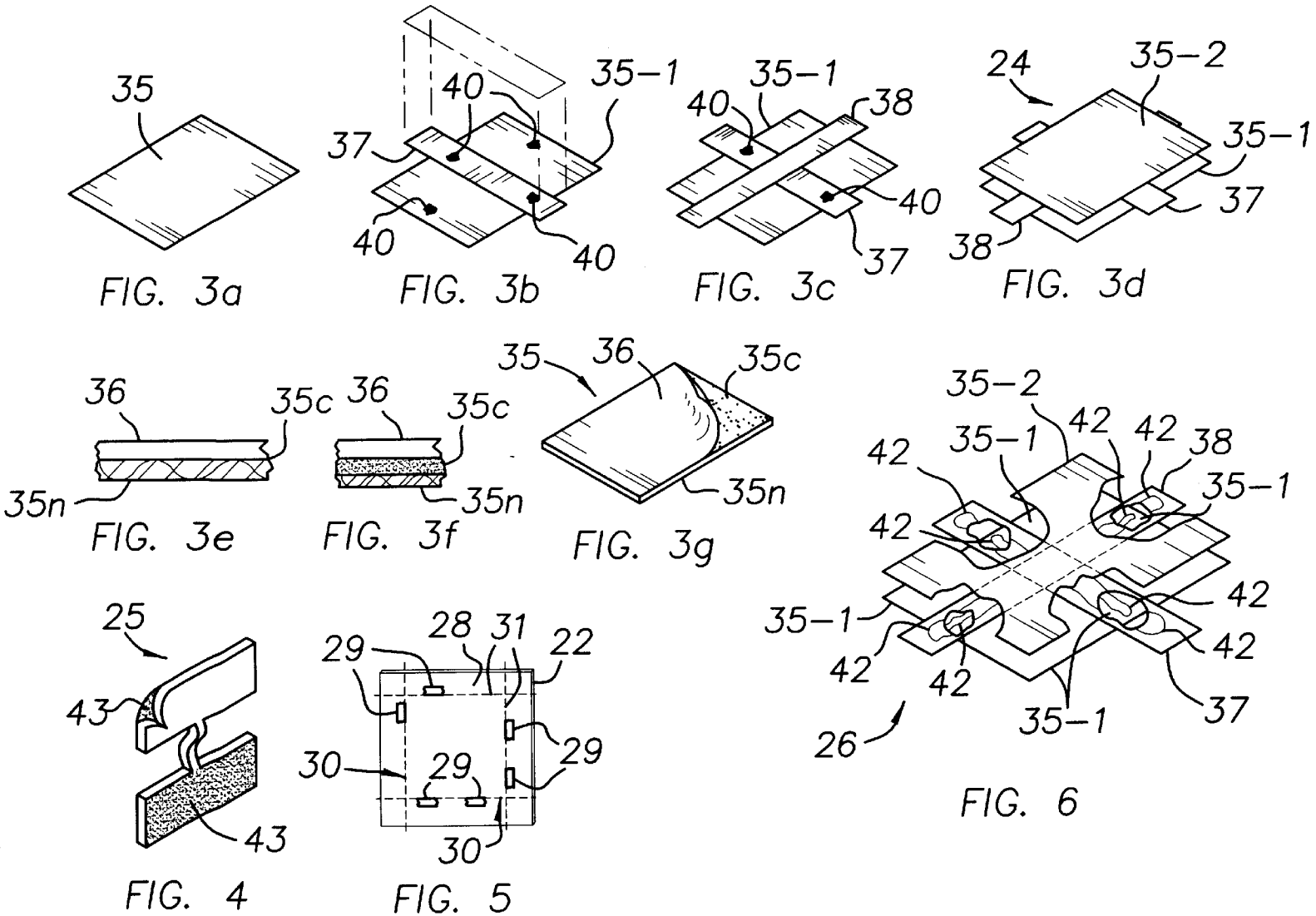
FIGS. 3*a*–3*d* are perspective views of a floater anchor and a manner of its construction.
FIG. 3*e* is a fragmentary cross-sectional view of material forming floater and hard anchors.
FIG. 3*f* is a magnified view of FIG. 3*e*.
FIG. 3*g* is a perspective view of the material of FIGS. 3*e*–3*f* and of which its protecting film or coating is partially removed showing an adhesive characteristic or layer as one of the material's elements or as a component incorporated in another element of the material and which represents a non-adhesive or neutral member in the material.
FIG. 4 is a perspective view of a soft anchor available for the practice of the invention.
FIG. 5 is a plan view of a backing on which accessory elements used in preliminary manner to preparing an assembly of artwork to backing is illustrated.
FIG. 6 is a perspective view, partly broken away, of FIG. 3*d*, however, modified to show the formation of a hard anchor in accordance with the invention.

A floater anchor member 24 is formed in a suitable size from two (2) pieces 35-1, 35-2 of material 35, FIGS. 3*a*–3*f*, and to which a pair of ties 37, 38 are fastened by specific spaced spots or globs 40 of glue 40, FIGS. 3*b*, 3*c*. Ties 37, 38 are in the nature of ordinary strips of paper. Each of the pieces 35-1 and 35-2 is made by cutting a pair of generally-equally sized pieces from a material 35, such as from the "filmoplast SH" [™] tape and are suitably sized in relation to a particular assembly 20 of sized artwork 21 and its backing 22. A first tie or strip 37, shown in phantom in FIG. 3*b*, is laid generally midway the length of the white linen material 35*n* and across the material's width as shown in solid lines in FIG. 3*b*. Four (4) spots or globs 40 of fastening glue are applied as shown in FIG. 3*b*, two (2) on the (white linen) piece 35-1 next to its opposing end edges and spaced a distance from each other, and two (2) to the topside of the tie 37 adjacent the lateral opposing edges of piece 35-1 and spaced a distance from each other. An end of a pin, a pointed end of a razor edge, a paper clip end, are examples (not shown) of an applicator by which the four (4) globs of glue are manually applied to their described points on piece 35-1 and tie 37. A second tie 38 is laid over the first laid tie 37, FIG. 3*c*, this time midway the lateral opposing edges of piece 35-1 while extending to the opposing end edges of piece 35-1, becoming fastened by its specific spots 40 of glue to the white linen side of the "filmoplast SH" [™] material (35). The white linen side 35*n* of the second piece 35-2 of the "filmoplast SH" [™] material (35) then is caused to face and be mounted over piece 35-1, FIG. 3*d*, becoming fastened to the two (2) specific spots or globs of glue 40 directly applied to the first laid tie 37 mounted on the white linen side 35*n* of piece 35-1. In other words, tie 37 is fastened to a material piece (35-2) to which it is not contiguous at its crossing area with tie 38, and tie 38 is fastened to a material piece (35-1) to which it is not contiguous at its crossing area with tie 37. The result is, after the drying of the spots or globs 40 of glue, and the crossing areas of the ties 37, 38 to one another, that the pieces 35-1 and 35-2 are interlaced to each other, without them separating from each other and having the capability of shifting between each other to the extent of the distances that space the spots of glue that have connected the ties 37, 38 to their corresponding pieces 35-1, 35-2. Preferably, the ends of ties 37, 38 that project past the edges of pieces 35-1, 35-2 are cut off. In action as utilized in the assembly of artwork to backing, the joined two pieces 35-1, 35-2 shift with respect to one another in terms of a slipping and/or guiding motion. A ¼" shifting motion has been found to be of a satisfactory extent as the artwork's substance expands or contracts under changes of temperature and humidity. Rippling and curling of artwork 21 when assembled to its backing 22 is prevented; and perhaps the same for other reasons as well, such as handling, shipping, etc., damage to the artwork does not occur. The artwork 21 floats free of the backing 22 under such conditions.

FIGS. 3*e* and 3*f* illustrate cross-sectional views of material 35. FIG. 3*e* is a fragmentary view that illustrates the non-adhesive or neutral member 35*n* to which the adhesive coating 35*c* has been either incorporated with member 35*n* into its manufacture or added thereafter so as to form material 35. The coating or film 36 protects adhesive coating 35*c* until the latter is ready for use. FIG. 3*f* represents the same view as FIG. 3*e*, however, magnified to illustrate the fact that an adhesive layer or coating 35*c* is included as part of the material 35. FIG. 3*g* illustrates that as the covering film 36 of the product "filmoplast SH" [™] tape, described above, is stripped from the coating 35*c* of material 35, that coating 35*c* is ready for utilization in the practice of the invention.

The invention also embraces a hard anchor member 26, FIG. 6, that is a modification of the combined elements of a floater anchor member 24. Rather than applying four distinct and spaced spots 40 of glue as shown in FIGS. 3*b*, 3*c* to ties 38 (via piece 35-1), 37, ribbons 42 of glue are laid first on neutral member 35*n* of piece 35-1 in continuous lines of glue (or other fastening elements) in the form of a cross. Ties 37, 38 are then placed on piece 35-1 as illustrated in FIG. 3*c*, and thereafter, ribbons 42 of glue are applied to the exposed surfaces of the ties 37, 38. Then piece 35-2 is applied or glued to both ties 37, 38. Upon drying of the ribbons 42 of glue, pieces 35-1 and 35-2 are fixed to one another, without the capability of motion between them. Preferably the ends of ties 37, 78 which project past the edges of pieces 35-1, 35-2 are cut off. The purpose of forming hard anchor 26 in this manner, rather than merely glueing together two (2) pieces 35-1, 35-2 or the like, is to provide preparation for ease of release of backing 22 from artwork 21 without damaging the latter, should a different or second backing be subsequently utilized.

One or more soft anchor members 25, FIGS. 2, 4, are manually applied to and at various locations on backing 22 and within boundary 30, their number, if used, depending upon the size and weight of artwork 22 which in turn assist in determining their number. These soft anchor members 25 are state-of-the-art fasteners, as described in and illustrated in FIGS. 7–11 of the noted U.S. Letters Pat. No. 5,437,428 and their disclosure in that patent are incorporated herein by reference thereto. A members 25 takes the form of a tape piece configured, for example, as by a scissor cutting, from the product "filmoplast SH" [™] tape and are manually applied to backing 22 within boundary 30 of artwork 21, i.e., so that they are out of view after artwork 21 is mounted and assembled to backing 22. Generally, a suitable number of members 25 are disposed in and at spaced locations or points on backing 22 as illustrated in FIG. 4 within the artwork's boundary 30, in order to support the weight of the substance of artwork 21, yet not preventing floatability of artwork 21 by floater anchor members 24.

In carrying out practice of the invention, the following description of steps is to be considered illustrative as one way in which to properly mount artwork to backing with the anchors disclosed herein, and it should not be considered as the only way to effect an effacacious mounting. A backing 22 is laid on a flat surface (not shown), such as a table top. Boundary 30 is first determined on backing 22 and indicia 29 mounted to the topside 28 of backing 22, FIG. 5, to assist in subsequently placing one or more of the kinds of anchor members 24, 25, 26 at suitable locations or points on backing 22. A hard anchor member 26 is applied to backing 22 along a reference line or point 32, FIG. 2, at the top of but within the boundary 30 for the artwork 21. Usually four (4) floater anchor members 24, FIG. 2, are applied to the backing 22 within the boundary 30 and within confines of corners of artwork 21, and at other locations determined for artwork 21 at suitable points in confines of corners of artwork 21 as well. One or more soft anchor members 25, FIGS. 4, 2, are applied, preferably to the extreme left and right, near the top, of artwork 21, to prevent pivoting or swinging of the artwork about hard anchor member 26. Also, one or more of them can be applied where necessary to support the weight of artwork to backing, where it is deemed best for such support. These applications of members 25 occur upon removing the protective coating or film 36 from the material 35 forming soft anchor member 25 but with removal at this point in the assembly only on one of its sides to expose its adhesive coating 43, FIG. 4, for manual application to the backing. The other adhesive side of anchor 25 remains protected by film or protective coating 36 (not shown in FIG. 4) until a later step in assembly.

With all applied anchor members 24, 25, 26 (or lesser number and/or kind if that be the case) now mounted to topside 28 of backing 22, the protective coating 36 is removed from all of them, to expose the adhesive coating 35*c* on them. As to each anchor member 24, the position of its material piece 35-2 to its material piece 35-1 is adjusted by shifting it so that it is directly over piece 35-1 in order to provide as much shifting in its motion as possible, such motion being translated into floatability for artwork 21 once firmly mounted to backing 22. Artwork 21 now is ready to be mounted to backing 22. It is carefully placed upon backing 22 within boundary 30. The artwork is first pressed hard immediately over hard anchor 26 and then manual pressure applied on artwork 21 immediately over or in line with the positions of the exposed adhesive coatings 35*c* of the in-place anchor members 24, and to anchor members 25 as well should they have been applied on backing 22. As much floatability as possible for artwork 21 on backing 22 has been achieved.

In the event that subsequently backing 22 is to be removed from artwork 21, it is apparent that backing 22 can be cut from each of the anchor members 24, 25, 26, if any one or some or all of them have been applied in a particular assembly 20, although portions of them remain on the backside of artwork 21. Nevertheless, the artwork is not damaged as its paper or substance has not been severed by such cutting.

Each of the anchor members 24, 25, 26 is readily made at the time of preparing assembly 20 for a particular artwork and backing, by cutting strips of paper 37, 38 and material 35 as exemplified by the "filmoplast SH" [™] tape product into their corresponding shapes.

Various changes and modifications of the anchor members themselves may be practiced without escaping or departing from the scope and/or spirit of the appended claims hereto. Preferably the anchor members 24, 25, 26 are preformed prior to any one of them being actually used in assembling a particular artwork 21 to a backing 22 as well as making or forming one or more of them at the time of a particular assembly 20 of artwork 21 to backing 22. The invention is not limited in its practice by use only of the "filmoplast SH" [™] product.

INDUSTRIAL APPLICABILITY

The invention is practiced in the artistic arts, and in the applied arts and industrial art industries, and is not necessarily limited thereto or thereby.

I claim:

1. An anchor member adapted to mount an artwork to a backing comprising a pair of material pieces one on top of the other, each of said material pieces including a neutral side facing the neutral side of the other of said material pieces and the other sides of said material pieces including adhesive characteristics thereto, tie means of lengths having crossing areas to each other in their lengths and disposed between said neutral sides, a first of said tie means fastened at a spacing along its length to the neutral side of the one of the material pieces to which it is not contiguous at such crossing areas, the second of said tie means fastened at a spacing along its length to the neutral side of the other of the material pieces to which it is not contiguous at such crossing areas, thereby interlinking said pair of material pieces, and means at the end of its spacing for fastening each of said tie means to the neutral side of the one of the material pieces that is contiguous to the other of said tie means at the crossing areas of said tie means, whereby a shifting motion between said material pieces by such interlinkage to the extent of the spacing of said tie means is achieved.

2. The anchor member of claim 1 wherein said fastening means comprises spots of glue.

3. The anchor member of claim 1 wherein each of said tie means comprises a strip of paper.

4. The anchor member of claim 1 wherein said fastening means comprises spots of glue, and each of said tie means comprises a strip of paper.

5. The anchor member of claim 1 or claim 2 or claim 3 or claim 4 including a protective cover for the adhesive characteristics mounted on said other sides of said material pieces.

6. An anchor member adapted to mount an artwork to a backing comprising a pair of material pieces one on top of the other, each of said material pieces including a neutral side facing the neutral side of the other of said material pieces and the other sides of said material pieces including adhesive characteristics thereto, tie means of lengths having crossing areas to each other in their lengths and disposed between said neutral sides, a first of said tie means fastened along its length to both neutral sides of said pair of material pieces, the second of said tie means fastened along its length to both neutral sides of said pair of material pieces, and means for fastening each of said tie means to both of said pair of material pieces, thereby fixing said pair of material pieces together.

7. The anchor member of claim 6 wherein said fastening means comprises a ribbon of glue.

8. The anchor member of claim 6 wherein each of said tie means comprises a strip of paper.

9. The anchor member of claim 6 wherein said fastening means comprises spots of glue, and each of said tie means comprises a strip of paper.

10. The anchor member of claim 6 or claim 7 or claim 8 or claim 9 including a protective cover for the adhesive characteristics mounted on said other sides of said material pieces.

11. An assembly of an artwork to a backing comprising a backing, an artwork mounted on said backing, and at least a combination of a hard anchor means and a floater anchor means connecting said artwork to said backing, said hard anchor means comprising a pair of material pieces one on top of the other, each of said material pieces including a neutral side facing the neutral side of the other of said material pieces and the other sides of said material pieces including adhesive characteristics thereto, tie means of lengths having crossing areas to each other in their lengths and disposed between said neutral sides, a first of said tie means fastened along its length to both neutral sides of said pair of material pieces, the second of said tie means fastened along its length to both neutral sides of said pair of material pieces, and means for fastening each of said tie means to both of said pair of material pieces, thereby fixing said pair of material pieces together.

12. The assembly of claim 11 wherein said floater anchor means comprises a pair of material pieces one on top of the other, each of said material pieces including a neutral side facing the neutral side of the other of said material pieces and the other sides of said material pieces including adhesive characteristics thereto, tie means of lengths having crossing areas to each other in their lengths and disposed between said neutral sides, a first of said tie means fastened at a spacing along its length to the neutral side of the one of the material pieces to which it is not contiguous at such crossing areas, the second of said tie means fastened at a spacing along its length to the neutral side of the other of the material pieces to which it is not contiguous at such crossing areas, thereby interlinking said pair of material pieces, and means at the end of its spacing for fastening each of said tie means to the neutral side of the one of the material pieces that is contiguous to the other of said tie means at the crossing areas of said tie means, whereby a shifting motion between said material pieces by such interlinkage to the extent of the spacing of said tie means is achieved.

13. The anchor means of claim 11 or claim 12 wherein said fastening means comprises spots of glue.

14. The anchor means of claim 11 or claim 12 wherein each of said tie means comprises a strip of paper.

15. The anchor means of claim 11 or claim 12 wherein said fastening means comprises spots of glue, and each of said tie means comprises a strip of paper.

16. The anchor means of claim 11 or claim 12 including a protective cover for the adhesive characteristics mounted on said other sides of said material pieces.

17. The anchor means of claim 13 including a protective cover for the adhesive characteristics mounted on said other sides of said material pieces.

18. The anchor means of claim 14 including a protective cover for the adhesive characteristics mounted on said other sides of said material pieces.

19. The anchor means of claim 17 including a protective cover for the adhesive characteristics mounted on said other sides of said material pieces.

20. The assembly of claim 12 including soft anchor means in combination with said hard anchor means and floater anchor means.

* * * * *

UNITED STATES PATENT AND TRADEMARK OFFICE

CERTIFICATE OF CORRECTION

PATENT NO. : 6,439,535 B1
DATED : August 27, 2002
INVENTOR(S) : Felix Mirza

It is certified that error appears in the above-identified patent and that said Letters Patent is hereby corrected as shown below:

Column 8,
Line 60, read "17" as -- 15 --.

Signed and Sealed this

Seventeenth Day of December, 2002

JAMES E. ROGAN
*Director of the United States Patent and Trademark Office*